US011963586B2

(12) United States Patent
Giaconia

(10) Patent No.: US 11,963,586 B2
(45) Date of Patent: Apr. 23, 2024

(54) BELT WITH AN ELASTIC INSERT FOR HOLDING A BUCKLE AND A RELATED MANUFACTURING METHOD

(71) Applicant: DANKE PELLETTERIA S.R.L., Scanzorosciate (IT)

(72) Inventor: Daniel Giaconia, Scanzorosciate (IT)

(73) Assignee: DANKE PELLETTERIA S.R.L., Scanzorosciate (IT)

( * ) Notice: Subject to any disclaimer, the term of this patent is extended or adjusted under 35 U.S.C. 154(b) by 263 days.

(21) Appl. No.: 17/622,978

(22) PCT Filed: Jul. 15, 2020

(86) PCT No.: PCT/IB2020/056642
§ 371 (c)(1),
(2) Date: Dec. 27, 2021

(87) PCT Pub. No.: WO2021/009687
PCT Pub. Date: Jan. 21, 2021

(65) Prior Publication Data

US 2022/0256979 A1 Aug. 18, 2022

(30) Foreign Application Priority Data

Jul. 15, 2019 (IT) ..... 102019000011757

(51) Int. Cl.
*A41F 9/02* (2006.01)
*A44B 11/00* (2006.01)

(52) U.S. Cl.
CPC ..... *A44B 11/008* (2013.01); *A41F 9/02* (2013.01)

(58) Field of Classification Search
CPC ..... A44B 11/008; A41F 9/02
See application file for complete search history.

(56) References Cited

U.S. PATENT DOCUMENTS 2,442,855 A * 6/1948 Luftig ..... A44B 11/008 2/322
6,842,912 B1 * 1/2005 King ..... A41F 9/002 2/311

(Continued)

FOREIGN PATENT DOCUMENTS

JP S5146520 U 4/1976
JP 2007044066 A 2/2007

(Continued)

OTHER PUBLICATIONS

International Search Report and Written Opinion for Corresponding International Application No. PCT/IB2020/056642, 11 pages, Nov. 27, 2020.

(Continued)

*Primary Examiner* — Katherine M Moran
(74) *Attorney, Agent, or Firm* — Lucas & Mercanti, LLP

(57) ABSTRACT

This disclosure shows a belt with a strap made of material which is substantially not elastically extendable. However, the belt adapts itself elastically to changes in the user's waist while maintaining the external appearance of the belts with a strap made of non-extendable material, because it has an elastic insert made of an elastic material, for example in polyester, folded on itself and fixed to an end of the strap in a longitudinally opposite position to a tip of the strap of the belt, and a buckle. The elastic insert is fixed to the strap so as to retain an anchoring bar of the buckle, so that the buckle can be removed longitudinally from the stem with a traction force that overcomes the restoring force of the elastic insert. A method of manufacturing such a belt with an elastic insert, for example in polyester, is also disclosed.

7 Claims, 10 Drawing Sheets

(56) References Cited

U.S. PATENT DOCUMENTS

| | | | | |
|---|---|---|---|---|
| 2003/0135913 | A1* | 7/2003 | Yang | A41F 9/002 2/338 |
| 2015/0282546 | A1* | 10/2015 | Silva | A41F 9/025 2/321 |

FOREIGN PATENT DOCUMENTS

| | | | |
|---|---|---|---|
| KR | 20110001628 | U | 2/2011 |
| WO | 2011045749 | A2 | 4/2011 |

OTHER PUBLICATIONS

First Examination for Corresponding European Application No. 20757663.8, 6 pages, Dec. 7, 2023.

* cited by examiner

PRIOR ART

BELT WITH AN ELASTIC INSERT FOR HOLDING A BUCKLE AND A RELATED MANUFACTURING METHOD

CROSS-REFERENCE TO RELATED APPLICATIONS

This application is a continuation of PCT/IB2020/056642, filed Jul. 15, 2020, which claims the benefit of Italian Patent Application No. 102019000011757, filed Jul. 15, 2019, the contents of each of which are incorporated herein by reference.

TECHNICAL FIELD

The present disclosure relates to belts and more particularly to a belt with an elastic insert for holding a buckle to the strap and a related manufacturing method of a belt.

TECHNOLOGICAL BACKGROUND

The belts are composed of a strap, that is a strip to be wrapped around the waist, hooked from one end to a buckle that engages a hole placed at the opposite end of the strap. Depending on how the buckle is held to the strap, the belts can be of the fixed-length type or of adjustable-length type. For example, in fixed-length belts the buckle may be fixed to the strap by folding one end of the strap around an anchoring bar of the buckle and by sewing the folded end of the strap so that the anchoring bar can no longer be released without removing the seams.

More typically, the strap 2 of the fixed-length belts has an end as shown in FIG. 1 with snap fasteners composed of male elements 1*a* and female elements 1*b*. By folding this end around the anchoring bar of the buckle and snapping the male 1*a* and female 1*b* elements of the snap fasteners together, the buckle remains constrained to the strap 2 until the snap fasteners are opened.

In order to shorten the length of the belts at will, the belts are made as shown in FIGS. 2 to 4 with three distinct parts: the strap 2, the buckle 6 and a hooking system consisting of a hooking strip 3 equipped with fixing means 1*a*, 1*b*. The strap 2 has through holes 4, as shown in FIG. 3, and is no longer folded around the anchoring bar of the buckle 6, but is held to it by the hooking strip 3, commonly called or "oval" for its shape, on which the two elements male 1*a* and female 1*b* of the snap fasteners are placed. When the hooking strip 3 is folded around the anchoring bar of the buckle 6, the strap 2 is crossed by the snap fasteners 1*a*, 1*b* and is firmly bound to the oval 3 together with the buckle 6.

As an alternative to snap fasteners, it is possible to use any other removable male-female fastening means, such as a screw 5 that crosses the strap 2 of the belt and engages a retainer, so that the end of the strap 2 folded around the anchoring bar of the buckle 6 remains held until the screw 5 is unscrewed from the retainer.

In any case, the shown belts have a fixed length, as they are not made of deformable material thus they cannot accommodate slight variations in the user's waistline, consequent to the normal weight fluctuations that can occur over time. As a result, hardly will be the belt comfortable because most of the time it will be slightly longer or slightly shorter than the user would desire.

Belts with an elastic strap are currently marketed, but they are more difficult to be shortened. Furthermore, they are subject to deformations over time and, when they are stretched to be tightened to the waist, they visibly become thinner and aesthetically are less pleasant than belts with a strap made of non-extendable material.

The document JP2007044066A, on the basis of which the preamble of claim 1 has been drafted, discloses an elastic belt of the type shown in FIGS. 5 *a* and 5*b*, that can be used to keep closed a suitcase. It comprises a portion of elastic fabric 4 which surrounds an anchoring bar of a buckle 51, wherein the portion of elastic fabric 4 is sewn on itself only so as to retain the anchoring bar of the buckle 51.

SUMMARY

Traction tests carried out by the applicant, by hanging a test weight to the belt, have shown that the solution illustrated in FIGS. 5*a* and 5*b* does not allow to achieve sufficient tensile strength to be implemented in belts to be used to support trousers. In particular, it has been found that an ordinary seam, of the type used for sewing leather belts, made on the elastic fabric 4 to surround the anchoring bar of the buckle 51, deteriorates rapidly until it breaks as soon as a weight greater than 10 Kg is hung to the belt. Such a limit makes the known elastic belt shown in FIGS. 5*a* and 5*b* unusable for holding trousers, since the seam on the elastic fabric 4 would break under the pressure of the user's body.

Without being bound to a theory, such a restrictive limit to the tensile strength in the elastic belt of FIGS. 5*a* and 5*b* should be due to the fact that the seam is made exclusively on the elastic fabric 4 and that thus the wire (or wires) of the seam are not anchored on a substantially non-deformable base. When the elastic fabric 4 is pulled, the points of the fabric 4 crossed by the seam thread tend to move one relative to each other, so that the threads are easily torn.

It has been designed and is the object of this disclosure a belt with a strap made of a material that substantially it is not elastically extensible. The belt, however, adapts elastically to changes in the user's waistline while maintaining the external appearance of the belts with non-extendable material strap. This excellent result has been obtained with a belt made with a manufacturing method as defined in the appended claims.

The belt of this disclosure has a strap made of a substantially non-elastically extendable material, an elastic insert made of an elastic material folded on itself and fixed to one end of the strap in a position longitudinally opposite to a tip of the belt strap, and a buckle. The elastic insert is attached to the strap, preferably within the strap, so as to retain an anchoring bar of the buckle, so that the buckle can be removed longitudinally from the strap with a traction force sufficient to overcome the restoring force of the elastic insert.

The elastic insert can be made, for example, of polyester, or elastodiene, or of a mixture of polyester and elastodiene. In one aspect, the elastic insert is made of 78% polyester and 22% elastodiene.

According to one aspect, the opposite edges of the elastic insert folded on itself are sewn with a bar tack to the strap, preferably inside the strap, so as to hold the anchoring bar of the buckle.

According to one aspect, one end of the strap opposite the tip is split in the direction of the strap thickness and defines two fins, between which the opposite edges of the elastic insert folded on itself are inserted.

According to one aspect, the elastic insert is hidden from view by an oval that defines two opposing flaps directed in the transverse direction, and a strip directed in the longitudinal direction, configured to be folded around the elastic insert, fixed together. The claims as filed are an integral part of this description and are herein incorporated by express reference.

DETAILED DESCRIPTION

The method of manufacturing a belt according to the present disclosure will be illustrated in detail with reference to FIGS. 6 to 19.

Figure 6:
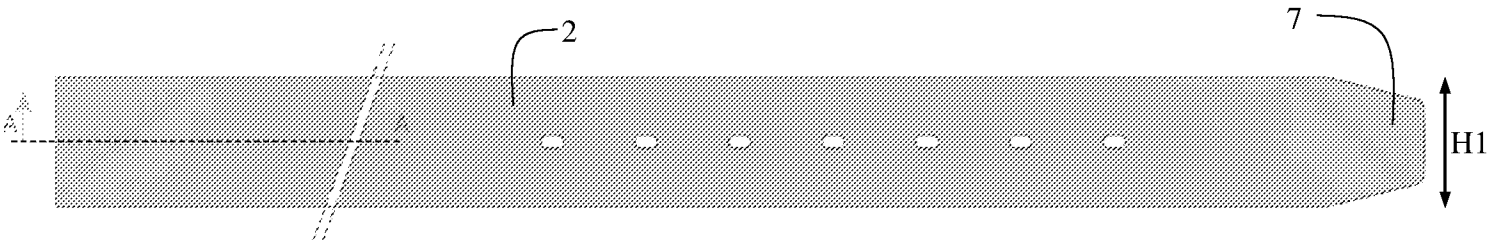
FIG. 6 shows a strap 2 for manufacturing a belt according to an aspect of the present disclosure with seven holes of the waistline defined longitudinally in a row.
Figure 7:
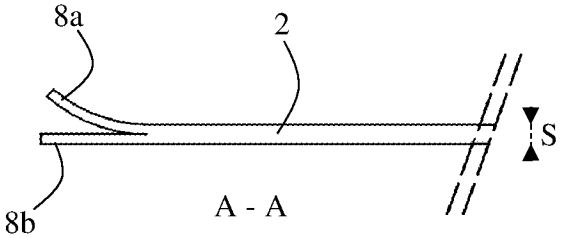
FIG. 7 is a profile view of the strap of a belt according to an aspect of the present disclosure split in the sense of the thickness to form two flaps.

FIG. 6 shows a strap 2 of a belt according to the present disclosure. It is made of a material not elastically extensible, such as a strip of leather, and the holes for adapting to the waist (in the figure there are seven holes) defined longitudinally in a row in a central position relative to the height H1 of the strap 2. In one aspect, the waist holes are spaced 29 mm apart. According to the manufacturing process of this disclosure, as shown in FIG. 7, the end of the strap 2, opposite to the tip 7 of the belt, is split longitudinally and in the thickness direction S of the strap 2. In this way, two fins 8*a* and 8*b* are created, preferably of equal thickness, which part from the strap 2.

Said fins 8*a* and 8*b* will preferably have a length comprised between 5 mm and 30 mm, more preferably between 10 mm and 20 mm, still more preferably a length of 15 mm.

Figure 8:
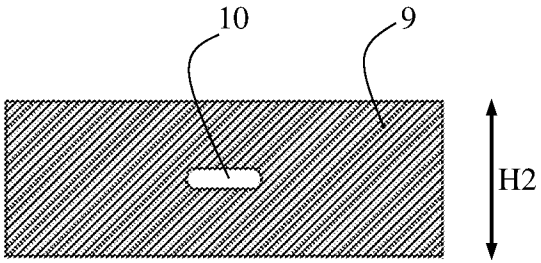
FIG. 8 shows an elastic insert 9 of a belt according to an aspect of the present disclosure, with a slot in which to insert the prong of a buckle.

According to the method of this disclosure, an elastic insert 9 is thus provided, which for example can be of polyester, which is a strip having a height H2 preferably smaller than the height H1 of the strap 2, for example of the type shown in FIG. 8, with a slot 10 in which to insert the prong of the buckle, if present. If, on the other hand, the buckle was of the type (not shown in the figure) consisting of a plate with a peg that slips into a hole in the belt, then in this case the elastic insert 9 may also not have any slots 10. Referring to the case shown in the figures, in which the buckle has a prong, if the prong of the buckle is inserted into the slot 10, the elastic insert 9 is folded around the anchoring bar 11 of the buckle, as shown in FIG. 8, and between the fins 8*a* and 8*b* formed in the thickness S of the strap 2 the opposite ends of the elastic insert 9 folded on itself are fixed. In this way, the elastic insert 9 is firmly fixed to the strap 2 of the belt.

In one aspect, the elastic insert 9 is an elastic fabric web.

Figure 9:
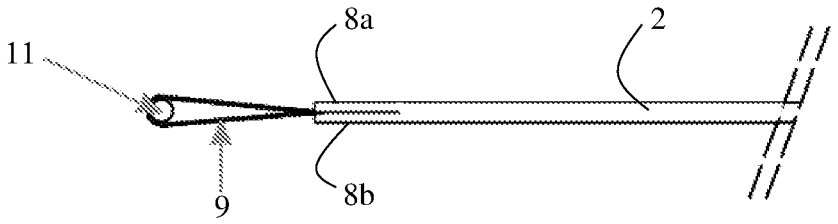
FIG. 9 shows the elastic insert folded around the anchoring bar of a buckle, with the opposite ends of the elastic insert folded on itself sewn between the fins obtained in the thickness S of the strap.
Figure 10:
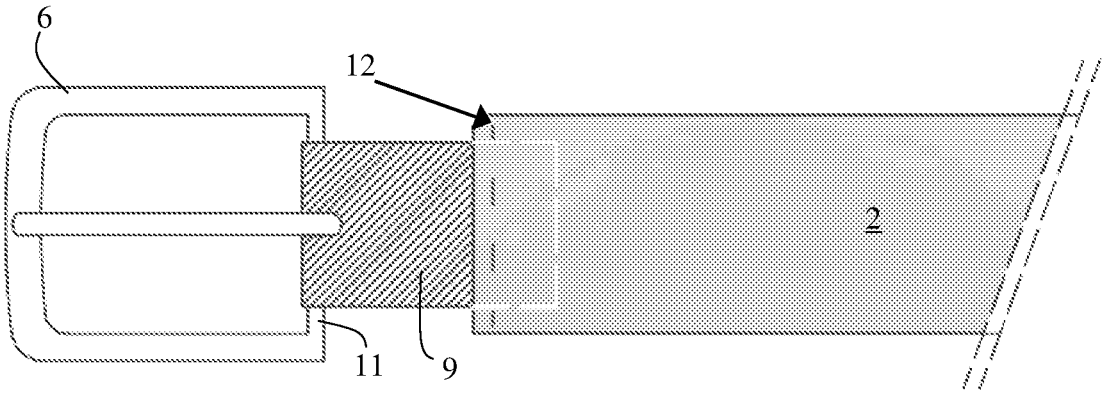
FIG. 10 shows the elastic insert of a belt according to an aspect of the present disclosure, fixed to the strap so as to retain the anchoring bar of the buckle.

As shown in FIG. 9 and FIG. 10, the ends of the elastic insert 9 folded on itself are sewn directly together with the strap 2 by means of a bar tack 12 which simultaneously passes through both the strap 2 and the elastic insert 9, with the fins 8 *a* and 8 *b* sandwiching the ends of the elastic insert 9.

According to less preferred aspects, not shown in the figures, the ends of the elastic insert 9 are glued between the flaps 8*a* and 8*b* and are sewn.

Once the elastic insert 9 has been fixed, the anchoring bar 11 of the buckle 6 is permanently hooked to the strap 2 as shown in FIG. 9.

Figure 11:
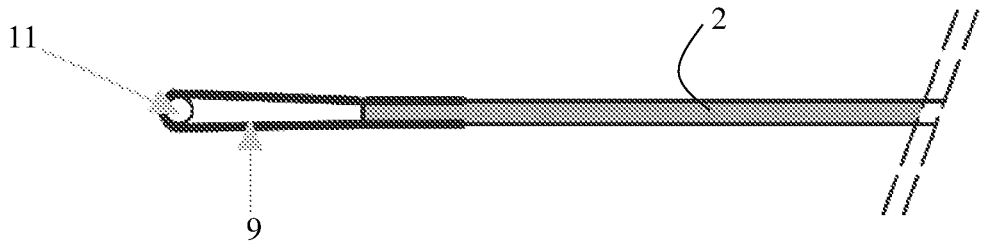
FIG. 11 shows the elastic insert folded around the anchoring bar of a buckle, with the opposite ends of the elastic insert folded on itself sewn directly on the strap so that the strap is sandwiched therebetween.
Figure 12:
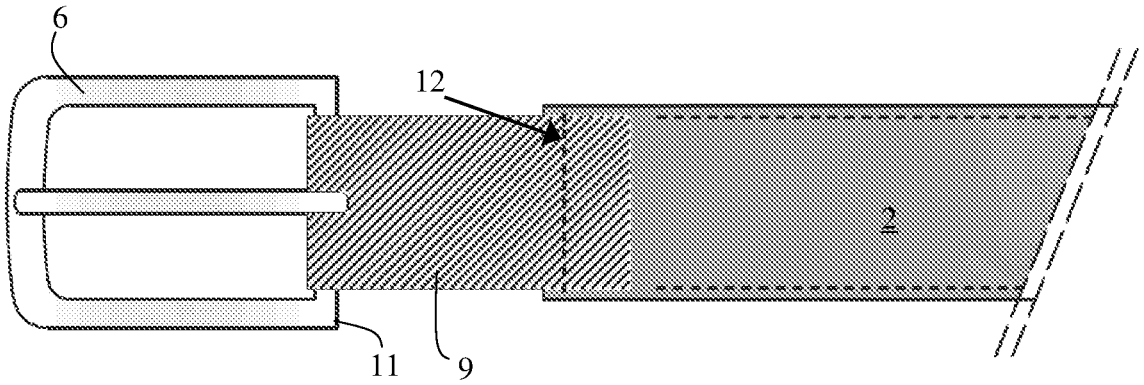
FIG. 12 shows the elastic insert of a belt according to an aspect of the present disclosure, directly sewn on opposite sides of the strap so as to retain the anchoring bar of the buckle.

According to an alternate aspect, the ends of the insert elastic 9 are sewn directly on the frame 2 in the manner shown in FIGS. 11 and 12, so that the same bar tacks 12 simultaneously passes through both the strap 2 and the elastic insert 9, with opposite ends of the elastic insert 9 which sandwich the strap 2. Also in this case, as in the embodiment of FIGS. 9 and 10, the elastic insert 9 is not sewn on itself, as in the belt disclosed in document JP2007044066A, but is firmly anchored to the strap 2 by means of the bar tack 12.

Experimental tests carried out by the applicant have shown that a belt made in the manner indicated in FIGS. 9 to 12, by sewing the elastic insert 9 directly on the strap 2 with a same bar tack 12, is capable of withstanding a weight of 80 Kg without being damaged.

Figure 13:
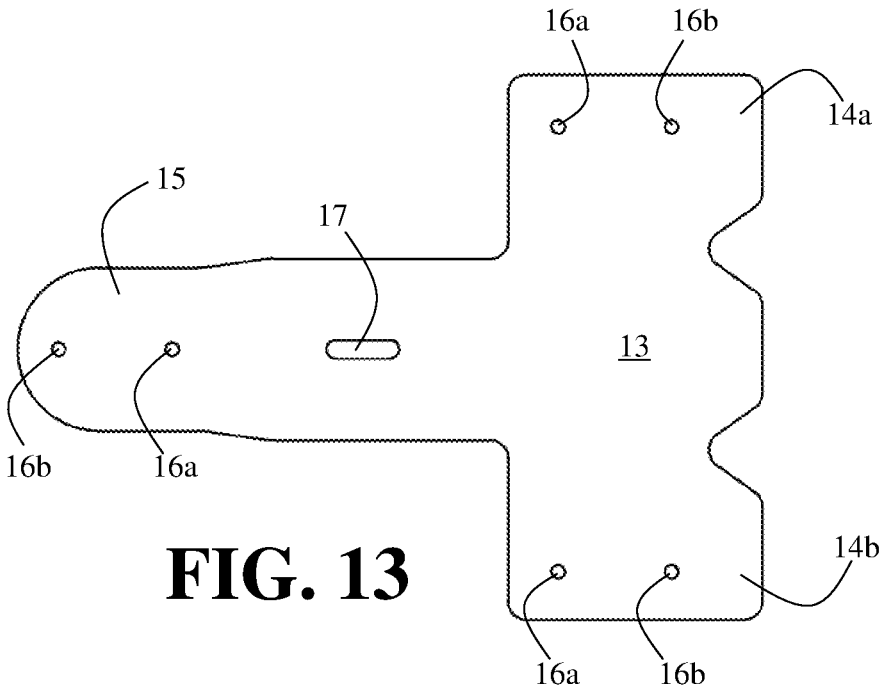
FIG. 13 shows an oval shaped to hide the elastic insert of FIG. 7, so as to define two opposed flaps directed transversely and a strip directed longitudinally.

In order to hide the bar tack 12 from view, which would be aesthetically unattractive, an oval 13 of the type shown in FIG. 13 is optionally provided, which is substantially an element made of material suitable for manufacturing belts, such as for example fabric or leather, shaped in such a way to define two opposing flaps 14*a* and 14*b* directed transversely and a strip 15 directed longitudinally. On each flap 14*a* and 14*b* and on the longitudinal strip 15 are defined holes 16*a*, 16*b*, intended to be engaged by removable or non-removable fixing means, such as, respectively, the male and female elements of snap fasteners or iron rivets. In a substantially central position a second slot 17 is defined, through which the prong of the buckle will be passed.

The figures show two holes 16*a* and 16*b* on each flap 14*a* and 14*b* and on the longitudinal strip 15. The choice of making two holes 16*a* and 16*b* is preferred because it is more aesthetically pleasing, but it is also possible to make a single hole 16*b* on each flap 14*a* and 14*b* and on the longitudinal strip 15, or even three or more holes arranged in various ways. Regardless of the number of holes made on each flap 14*a* and 14*b* and on the longitudinal strip 15, they will be arranged so that the corresponding holes 16*a*, 16*b* are superimposed when the flaps 14*a* and 14*b* and the longitudinal strip 15 are folded around the elastic insert 9, so that the corresponding holes 16*a*, 16*b* are simultaneously engaged by removable fixing means, to keep the flaps 14*a* and 14*b* and the strip 15 folded around the elastic insert 9.

Figure 14:
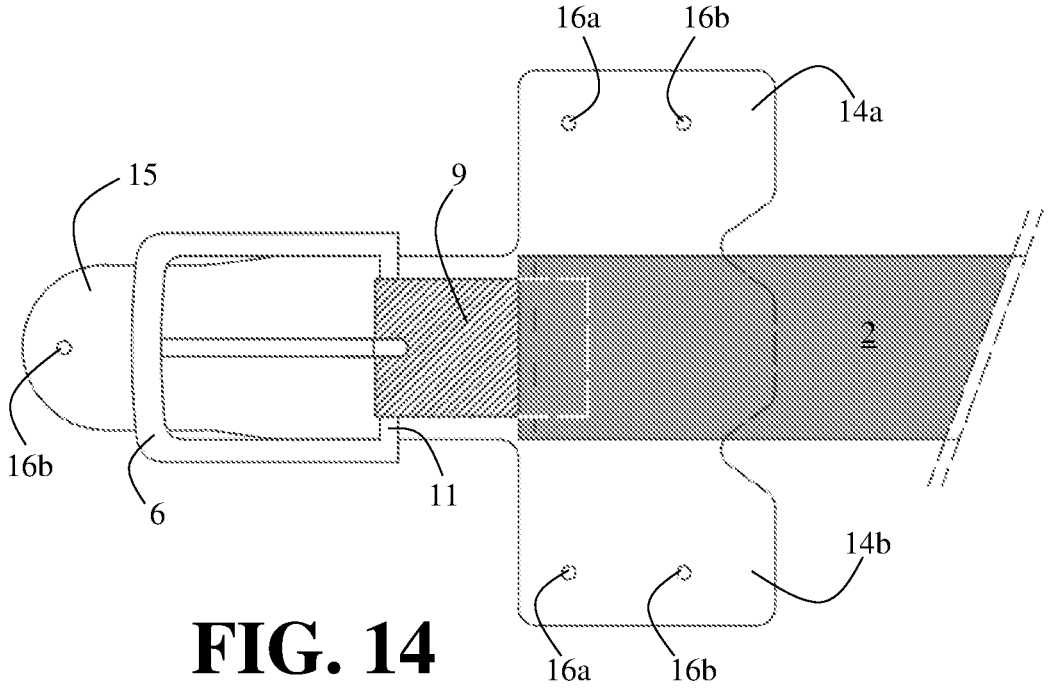
FIGS. 14, 15 and FIG. 16 show in succession how to place and close the oval of FIG. 13 respectively so as to hide the elastic insert, according to the manufacturing method of the present disclosure.
Figure 15:
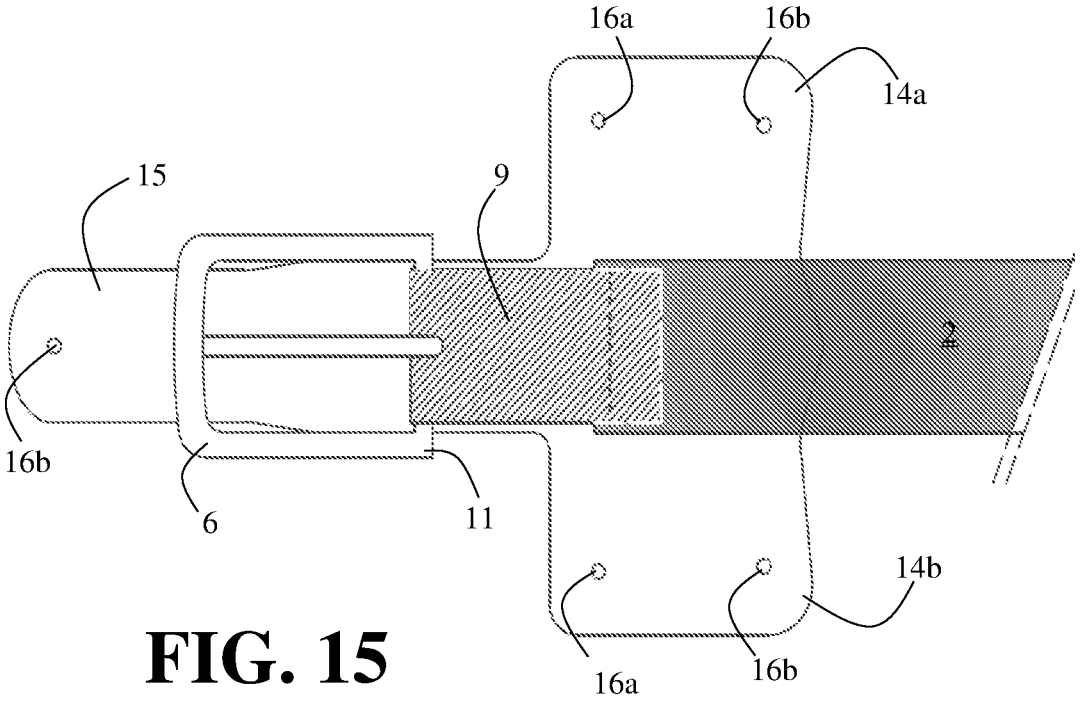
Figure 16:
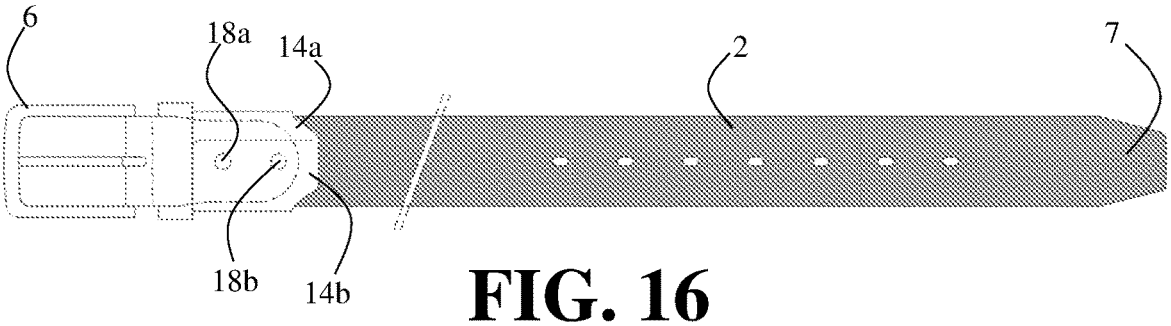

As shown in FIGS. 14, 15 and 16, according to the manufacturing process of this disclosure:

the oval 13 is placed in correspondence with the elastic insert 9 fixed to the strap 2, the prong of the buckle 6 is inserted in the second slot 17, the longitudinal strip 15 is folded around the anchoring bar 11 of the buckle 6 longitudinally to the strap 2, the flaps 14*a* and 14*b* are folded transversely to the strap 2, so as to overlap the holes 16*a* between them and the holes 16*b* between them, fixing means 18*a*, 18*b* are inserted to engage the holes 16*a* and 16*b* together, respectively, so as to keep the oval 13 in a closed configuration to hide the elastic insert 9 from view.

Figure 1:
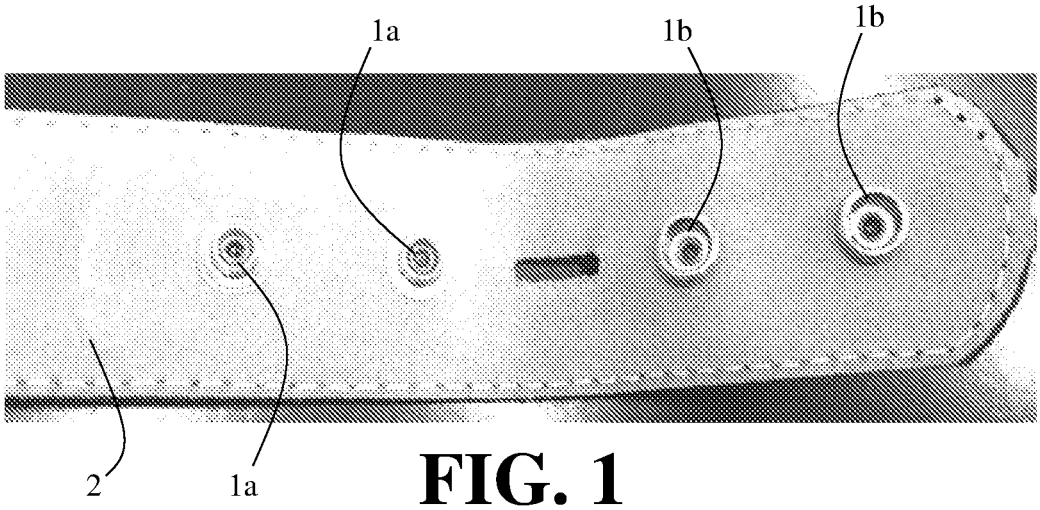
FIG. 1 shows a snap fastener end of a belt whose length cannot be adjusted.
Figure 2:
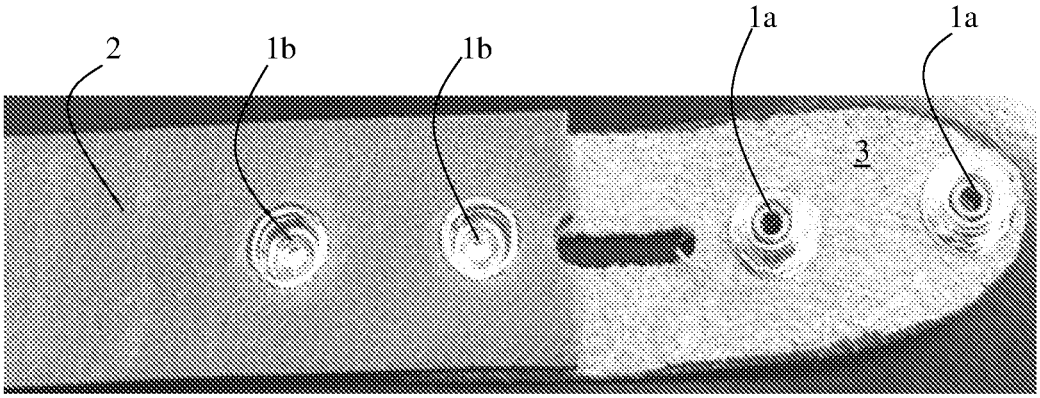
FIG. 2 shows a snap fastener end of a belt adjustable in length with the strap separated from the hooking strip.
Figure 3:
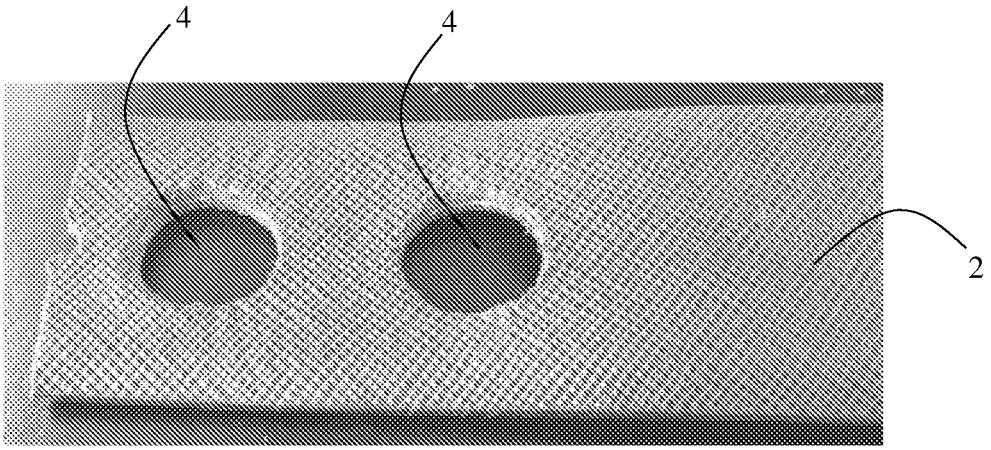
FIG. 3 shows a strap of a belt with through holes for hooking to the snap fasteners of a hooking strip.
Figure 4:
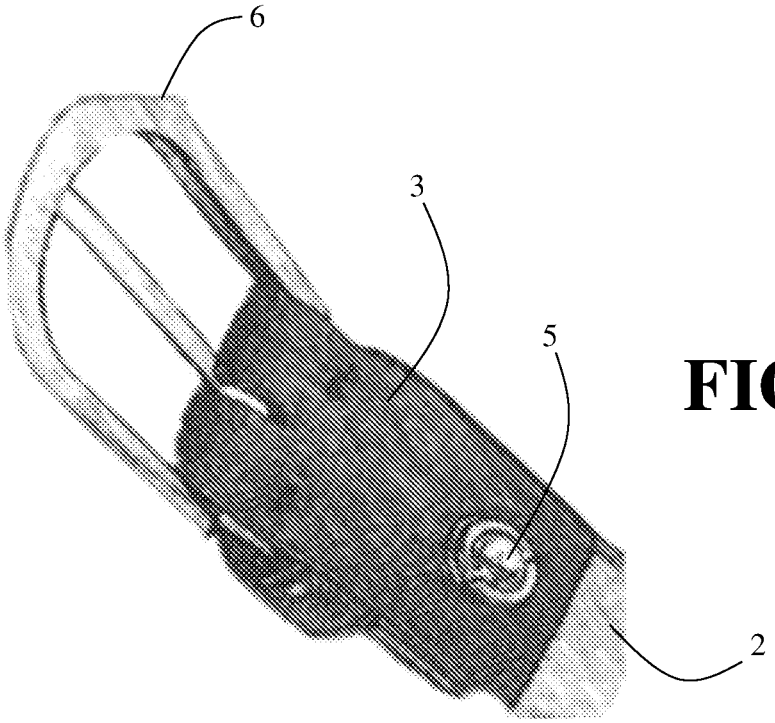
FIG. 4 shows a hooking strip of a belt closed around a buckle by means of a screw inserted in the relative retainer.
Figure 5A:
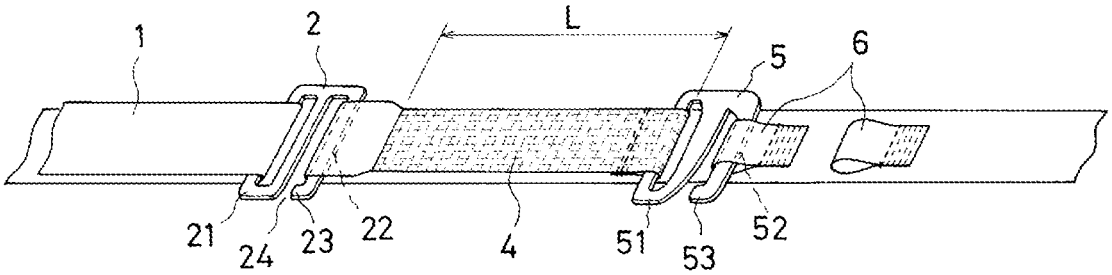
FIG. 5a PRIOR ART
FIGS. 5*a* and 5*b* are perspective and profile views of a known elastic belt.
Figure 5B:
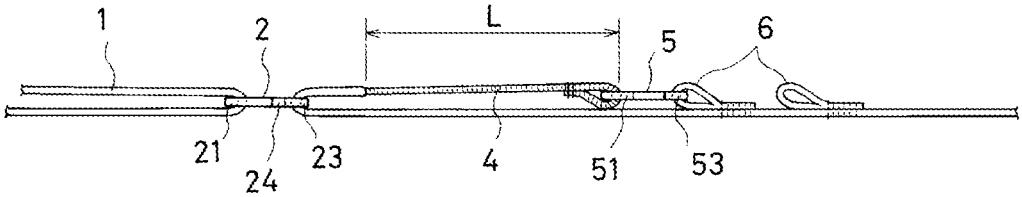
Figure 17:
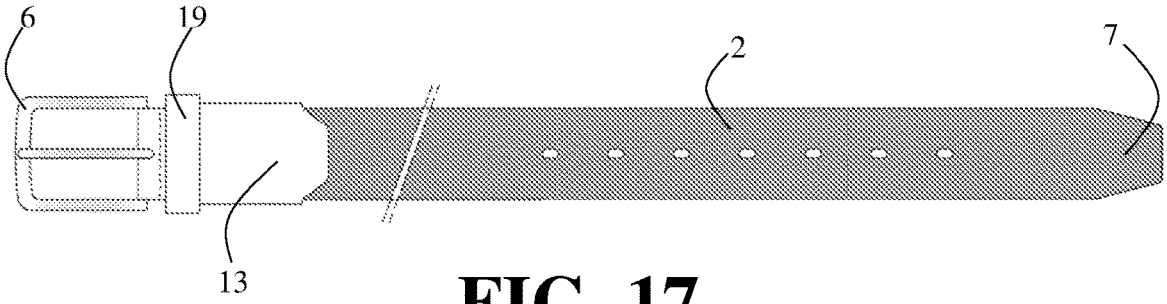
FIG. 17 is a front view of a belt according to the present disclosure.

The inside and the outside of the mounted belt will appear respectively as shown in FIGS. 16 and 17. Unlike the belts which can be shortened with an oval, such as that of FIG. 2, in the belt of the present disclosure the oval 13 is not fixed directly to the strap 2 of the belt but is hooked only to the anchoring bar 11 of the buckle 6. By pulling the buckle 6 in the direction longitudinal to the belt, the insert elastic 9, for example made of polyester, elastically elongates and the strap 2 moves away from the buckle 6 sliding in the middle of the flaps 14*a* and 14*b* of the oval 13 closed on themselves.

Preferably, a ring 19 is fixed on a face of the oval 13 intended to remain outside the belt, so as to constitute a loop in which to insert the tip 7 of the belt once tightened at the waist.

Figure 18:
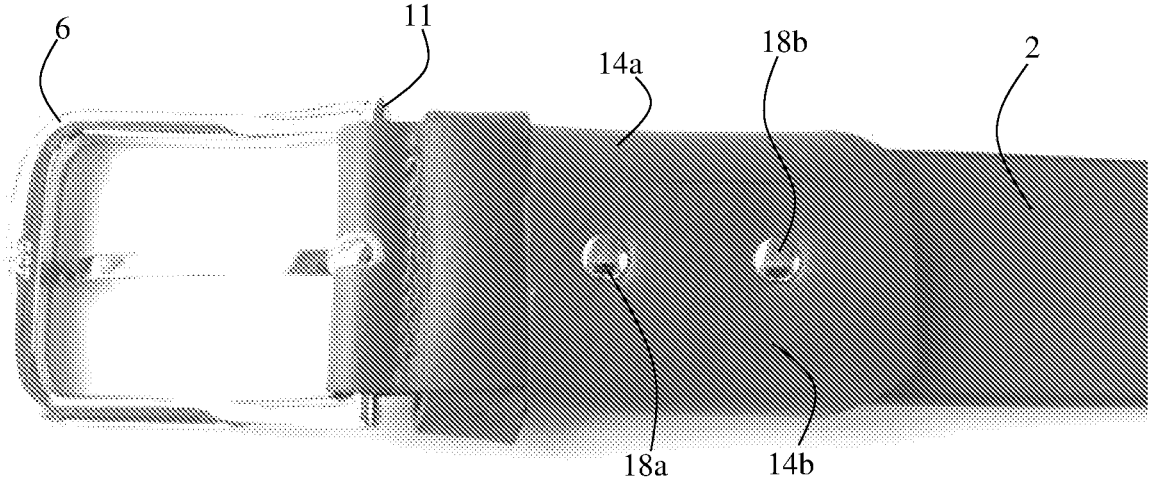
FIGS. 18 and 19 are pictures of the external and internal side, respectively, of a part of a leather belt made according to the method of this disclosure.
Figure 19:
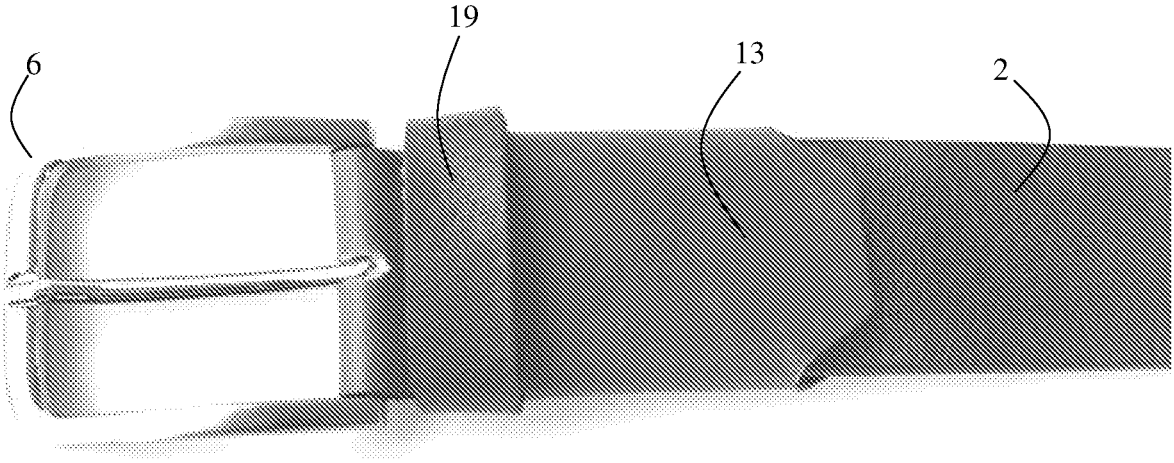

Working prototypes of belts have been made according to the process of this disclosure. Pictures are shown in FIGS. 18 and 19 respectively of the outer side and of the inner side of a part of a prototypal leather belt. The oval 13, kept in the closed configuration by the rivets 18*a* and 18*b*, hides the elastic insert 9 from sight. The strap 2 of the belt is enveloped by the oval 13 but can slide in it by pulling the tip 7 of the belt overcoming the restoring force of the elastic insert 9.

With the disclosed method it is also possible to make straps for bags or wrist watches.

The invention claimed is:

1. A belt, comprising:

a strap made of a substantially non-elastically extensible material, defining a tip of the belt;

a buckle having at least one anchoring bar for anchoring the buckle to the strap;

an elastic insert made of an elastic material folded on itself and having opposite edges fixed to one end of the strap in a longitudinally opposite position to the tip of the belt, wherein said elastic insert is fixed to the strap to hold the anchoring bar of the buckle, and is configured so that the buckle can be moved longitudinally away from the strap with a tensile force sufficient to overcome the restoring force of the elastic insert, wherein the opposite edges of the elastic insert folded on itself are sewn with a bar tack directly on or in the strap, with said bar tack passing through both the strap and through said opposite edges of the elastic insert to hold the anchoring bar of the buckle; wherein the end of the strap opposite to the tip is split longitudinally in the thickness of the belt, such that a first fin and a second fin are defined by the split end, wherein the opposite edges of the elastic insert folded on itself are sewn with said bar tack between said first and second fins, wherein the bar tack simultaneously passes through both the strap and the elastic insert, with the first fin and the second fin sandwiching the opposite edges of the elastic insert.

2. The belt according to claim 1, further comprising a body of material suitable for manufacturing belts defining a first flap and a second flap opposed one another in a transverse direction and a strip directed in a longitudinal direction, wherein said first flap and second flap and said strip are configured to be folded around the elastic insert and to be fixed together by means of removable or non-removable fixing means.

3. The belt according to claim 2, wherein corresponding holes are defined on said first flap and second flap and on said strip, configured to be superimposed on each other when said first flap and second flap and said strip are folded around the elastic insert, and configured to be engaged by said removable or non-removable fixing means.

4. The belt according to claim 2, wherein said removable or non-removable fixing means are composed either of male and female elements of snap-buttons, or of rivets, respectively.

5. A method for manufacturing a belt having a strap made of a substantially non-elastically extensible material, defining a tip of the belt, and a buckle having at least one anchoring bar for anchoring the buckle to the strap, said method comprising the following operations:

providing an elastic insert of elastic material and folding it onto itself around said anchoring bar of the buckle;

fixing opposite edges of the elastic insert at one end of the strap in a longitudinally opposite position to the tip of the belt to retain said anchoring bar of the buckle, through the operations of sewing the opposite ends of the elastic insert folded on itself with a bar tack directly on or in the strap, with said bar tack passing through both the strap and through said opposite edges of the elastic insert to hold the anchoring bar of the buckle, wherein said method further comprises:

splitting the end of the strap opposite to the tip longitudinally in the thickness of the belt such that a first fin and a second fin are defined by the split end;

sewing said opposite edges of said elastic insert between said first fin and second fin with said bar tack, wherein the bar tack simultaneously passes through both the strap and the elastic insert, with the first fin and the second fin sandwiching the opposite edges of the elastic insert.

6. The method according to claim 5, comprising the operations of:

providing a body of material suitable for making belts defining a first flap and a second flap opposite to one another directed in a transverse direction and a strip directed in a longitudinal direction, wherein said first flap and second flap and said strip are configured to be folded around the elastic insert;

defining corresponding holes on said first flap and second flap and on said strip;

folding said first flap and second flap and said strip around the elastic insert to overlap said corresponding holes;

engaging said corresponding holes with removable or non-removable fixing means to hold said first flap and second flap and said strip folded around the elastic insert.

7. The method of claim 6, wherein the non-removable fixing means are fixed rivets.

* * * * *